US005114388A

United States Patent [19]

Trulaske

[11] Patent Number: 5,114,388

[45] Date of Patent: May 19, 1992

[54] STAIR SIMULATOR EXERCISER WITH ADJUSTABLE INCLINE

[75] Inventor: James A. Trulaske, Town & Country, Mo.

[73] Assignee: True Fitness Technology, Inc., O'Fallon, Mo.

[21] Appl. No.: 736,724

[22] Filed: Jul. 26, 1991

[51] Int. Cl.[5] ..... A63B 23/04

[52] U.S. Cl. ..... 482/52

[58] Field of Search ..... 272/69, 70, DIG. 4, 272/130, 73, 96, 135

[56] References Cited

U.S. PATENT DOCUMENTS 3,592,466 7/1971 Parsons ..... 272/69
3,970,302 7/1976 McFee .
4,358,105 11/1982 Sweeney, Jr. .
4,470,597 9/1984 McFee .
4,477,072 10/1984 DeCloux .
4,496,147 1/1985 DeClous et al. .
4,519,603 5/1985 DeCloux .
4,681,316 7/1987 DeCloux .
4,685,666 8/1987 DeCloux .
4,685,669 8/1987 DeCloux .
4,704,886 12/1972 Kay et al. .
4,708,338 11/1987 Potts .
4,720,093 1/1988 Del Mar .
4,749,181 7/1988 Pittaway et al. .
4,792,134 12/1988 Chen .
4,844,449 7/1989 Trulaske .
4,848,737 7/1989 Ehrenfield .
4,886,266 12/1989 Trulaske .
4,913,396 4/1990 Dalebout et al. .
4,938,474 7/1990 Sweeney et al. .
4,949,993 8/1990 Stark et al. .
5,004,224 4/1991 Wang ..... 272/70

*Primary Examiner*—Stephen R. Crow
*Attorney, Agent, or Firm*—Paul M. Denk

[57] ABSTRACT

A stair simulator exerciser for use in maintaining personal fitness including a frame member, the frame member having a column provided at its frontal portion, the column may incline rearwardly, a pivotal assembly is mounted for approximate vertical adjustment upon the column, and a pair of pivotally disposed foot platforms connect with the assembly. When the assembly is raised upon the column, the foot platforms undertake a particular arc of movement with respect to the frame member, but that when the pivotal assembly is arranged downwardly, upon the column, the angle of the arc of shifting of the foot platforms differ from the previous setting. Structure is provided for regulating the degree of resistance to the downward movement of the foot platforms during performance of an exercising function.

15 Claims, 3 Drawing Sheets

STAIR SIMULATOR EXERCISER WITH ADJUSTABLE INCLINE

BACKGROUND OF THE INVENTION

This invention relates generally to an exercising device, and more specifically, pertains to a stair simulator type of exercising means wherein both the degree of resistance offered to the exerciser while manipulating the foot platforms may be varied, while likewise the arc angle of pivot to the foot platforms during their manipulation may be changed, so as to provide exercising motion duplicative of either ladder climbing or stair ascending, depending upon the adjustment made to the exerciser.

A myriad of exercising devices are readily available in the art. For example, the inventor herein possesses a variety of patents upon various types of treadmill devices, for use for providing exercising to the user that simulates walking, either in the foreward and/or rearward direction, and upon a level or inclined disposition. These can be seen in the U.S. Pat Nos. 4,886,266, and 4,844,449. In addition, there are many types of stair climbing simulating exercising devices that are available in the art, but which offer normally a single dimension per exertion by the exerciser, and that is simply to undertake movement relating to that of climbing stairs. Furthermore, exercising devices have likewise undertaken the configuration of a ladder,, so that exercising may be undertaken that is related to and requires muscle exertion that simulates the climbing of a ladder, as can be see in U.S. Pat. No. 4,848,737 to Ehrenfield. Furthermore, various exercising devices have incorporated means for varying and adjusting the amount of speed or resistance that can be exerted by the exercising device against the party undertaking such activity. For example, in U.S. Pat. No. 4,792,134 to Chen, a treadmill with an adjusting mechanism is shown therein, incorporating various crankshafts, sector gears, and the like, generally for varying the speed of movement of the treadmill belt, are provided in the art.

The current invention, on the other hand, is believed to significantly improve upon exercising devices that simulate stair climbing, by not only providing mechanical means for varying the resistance offered to the exerciser while attempting to manipulate the foot platforms simulating stair movement, but at the same time, provide further means for adjustment that varies the angle of stair simulating platform pivot, so as to change the orientation of the simulated stairs, and thereby vary the degree of force exerted upon select or additional muscles particularly of the foot, ankle, calf, and thigh, during the undertaking of exercising movements.

SUMMARY OF THE INVENTION

The concept of this invention is to provide an improvement to the stair climbing exercise machine through the utilization of an adjustable pivot point for the stair step foot platforms in order to change the grade of the steps, and thereby vary the resistance offered to the select muscles of the body, particularly in the leg region, when exposed to exercising upon the apparatus of this invention. As previously stated, in the fitness industry, there are basically two different ways that manufacturers have simulated stairs. One is the older method that is very similar to the operations of an escalator, wherein the full sized platforms revolve on an angled conveyor system. The newer and more common method for attaining such simulation is done with platforms that are attached to the ends of pivot arms, with the arm ends opposite the platforms being attached to a frame with a hinged assembly. The arms are controlled with a counterbalancing system, that returns the arms to the uppermost position, after pressure from descending has been removed.

The concept of the current invention is to raise and lower that pivot point for the arms, so as to change the angle that the platforms descend from the upper position, during performance of an exercising routine. Thus, the provision of an adjustable pivot point on a newly improved stair step machine, in order to change that simulated angle the user would be subjected to when ascending the simulated stairs, is what is provided through the arrangement of this apparatus. In other words, the step platforms embodied in this machine provide an adjustable incline, or variation in the orientation of the arc angle undertaken by the foot platforms during their manipulation, and hence, which is also undertaken by the feet and legs of the exerciser, during performance of a routine.

Hence, changing the step angle from a stair climbing action to a ladder ascending procedure thereby changes the toning to which the muscles of the legs are subjected to during usage of this invention. Thus, through usage of this current device, the user can work and develop a much wider range of muscles in the legs, as a result of the adjustable features constructed into this apparatus. Changing of the step angle increases and decreases the workload exerted upon the legs, depending upon the position of the adjustment. Thus, when the perferred apparatus is regulated such that its pivot assembly is maintained at its highest disposition, within the framework of this invention, then a ladder climbing simulated action is encountered. On the other hand, when the pivot assembly of this invention is regulated into a lowermost disposition, a stair action is encountered, and such action is generally recognized as being easier for the user to accommodate, while providing a lesser strenuous form of exercise, such as for those who may be somewhat impaired, or subjected to handicaps that require therapy, or when the apparatus is used and employed by the elderly person. This adjustable inclined feature, which varies the orientation of the arc angle of movement of the foot platforms, provides an alternative to the changing of the workload other than through increasing or decreasing the rate of ascent, as attained by other devices.

On the other hand, the structure of this invention includes means for varying the degree of resistance offered by the foot platforms, when depressed, during usage of the exercising simulator of this invention.

Structuralwise, this invention includes a frame member, of compact size, and having convenient disposition of its various structures, so as to faciliate usage of this apparatus by the user. The frame means includes at least one columnlike member, that may be arranged either vertically, or angulated, with respect to its positioning at a frontal location within the frame means, and slideably and adjustably mounted upon the column is a pivot assembly. The pivot assembly includes means for pivotally mounting of the foot platforms of this invention, which may be pivoted to a particular angle, along an arc, dictated by the pivot point of the foot platforms in their connection with the pivot assembly. Means is provided for adjusting the disposition, along a vertical or proximate vertical angle of the pivot assembly upon its column, such that when the assembly is arranged at its lowermost position, upon the column, as previously explained, exercising upon this simulator is equivalent to stair climbing. On the other hand, when the pivot assembly is adjusted upwardly, with respect to the column, and particularly when the column is arranged at a rearwardly inclined angle within the frame means, the foot platforms undertake a movement that simulates ladder climbing, during its usage.

Means are provided for furnishing the various adjustments to this invention, during its usage. Initially, means is provided for furnishing that shifting of the pivot assembly upon the column. This can be achieved by a variety of methods, either mechanically by some form of a rack and pinion means, that may be physically manipulated, or a motor means, preferably of the reversing type, in combination with a screw, that threadedly connects with the assembly, may be employed for automatic readjusting of the pivot assembly with respect to its supporting column.

Secondly, means are provided for varying the degree of resistance provided by the foot platforms when the exerciser stands upon them, and undertakes the defined exercising movements. This resistance, likewise, can be achieved by a variety of means, which may be attained through the usage of any type of force biasing means, such as a spring, to attain such resistance mechanically, or adjustment feature may be designed into its construction, as through the usage of a form of flywheel, in combination with the gear reducer, and which may be adjusted for varying the degree of resistance encountered by the exerciser, when standing upon the foot platforms, and undertaking their manipulation during the performance of an exercising function. These are just examples of the type of mechanical means that may be built into this invention, in order to achieve its desired results.

Furthermore, and as is known in the art, various displays may be furnished for providing a read-out of select data, which is so desirable to the people utilizing these types of apparatuses, this day and age. Hence, either mechanical or electronic counter means may be furnished, for providing, for example, a read-out of the speed or rate of manipulation of the foot platforms, during exercising, or, in addition, furnish a read-out of the degree of force encountered during conjunction with computer means, so as to provide a digital display and read-out of such information, where desired.

It is, therefore, the principal object of this invention to provide a stair simulator with adjustable incline and which may be set to simulate a stair climbing ascending action, or a ladder climbing movement.

Another object of this invention is to provide a stair simulator wherein means is provided for manipulating the invention for use in either one of the defined movements, so as to vary the forces that are exerted upon the exerciser during undertaking of such action upon this invention.

Another object of this invention is to proivde means for varying the arc angle of foot platforms utilized in a stair simulator, so as to provide for a change in the degree of exertion, and the type of exertion, that may be encountered by the muscles of the exerciser during usage of ths invention.

A further object of this invention is to provide mechanical or electrical means useful for providing instant readjustment to the stair simulator of this invention in order to vary the capacity of its application when utilized by one undertaking various exercising functions.

These and other objects may become more apparent to those skilled in the art upon reviewing the summary of this invention, and upon undertaking of the description of its preferred embodiment, in view of the drawings.

DESCRIPTION OF THE PREFERRED EMBODIMENT

Figure 1:
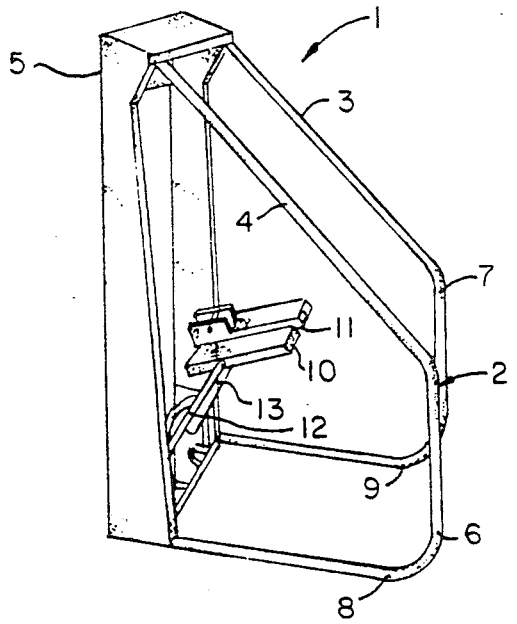
FIG. 1 provides a perspective view of the stair simulator exerciser of this invention, with its various bisymetric covering means provided in place.

In referring to the drawings, and in particular FIG. 1, the stair simulator of this invention 1 is disclosed. It includes a frame means, as at 2, which is configured having a pair of inclined hand gripping members 3 and 4, that connect into the housing or cover 5, at its upper end, while extending downwardly, integrally, as at 6 and 7, into base supporting frames 8 and 9, as noted. The frontal ends of the base frames 8 and 9 connect into the housing 5.

The concept of this invention is to provide for stair simulating, during exercising. Thus, a pair of foot platforms, 10 and 11, are pivotally disposed by means of pivot arms, as at 12 and 13, into the operating mechanism of this invention. Thus, as one undertaking exercises stands upon the foot platforms, and pivots the platforms downwardly against their resisting movements, during usage, this simulator provides a duplication of the effort that is related to either the ascending of stairs, or climbing of a ladder, as aforesaid, both with some degree of resistance.

Figure 2:
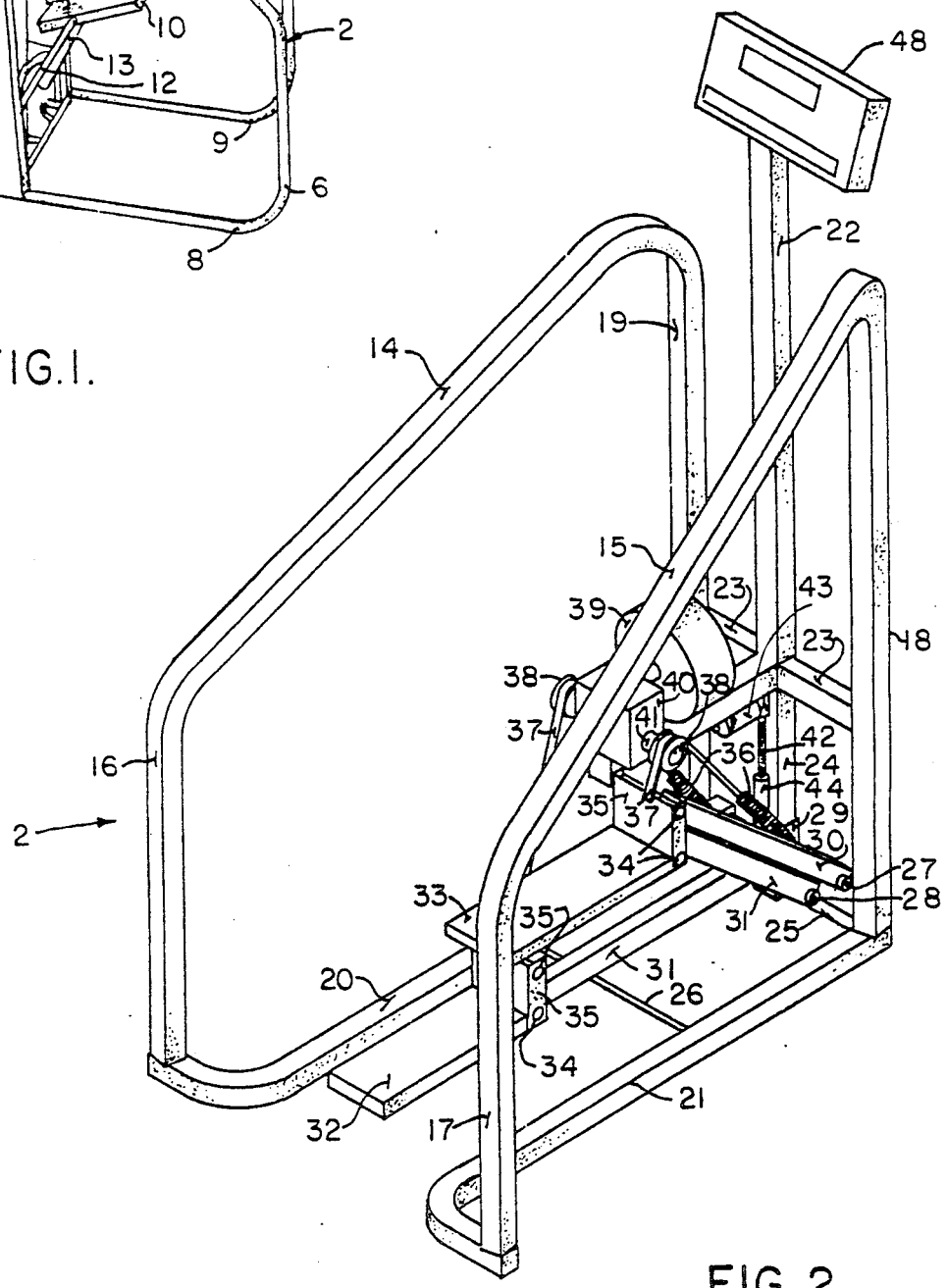
FIG. 2 provides a view of a further embodiment of this invention, with its covering means removed, in order to disclose its various operative components.

In referring to FIG. 2, the frame means 2 of this invention, without any housing or cover 5, is disclosed. In this particular embodiment, the construction of the device is slightly revised, as to be explained, although the principle to be obtained from its usage and application remains the same. As disclosed, the frame means includes the hand gripping inclined members 14 and 15, which have downwardly depending structural members, at their front and back ends, as can be seen at 16 through 19, and which respectively connect with their floor or base frames 20 and 21, as noted. Provided centrally of the frame means is a column member 22, which at its upper end provides means for furnishing a visual display, and read-out, of various data, whether it be indigital or analog form, providing information that may be relevant to the rate of usage of the exercising device, the degree of force encountered upon manipulation of its platforms, and the like. This type of information may be supplied electrically, or even mechanically, from the operative components of this invention, to be subsequently described. Such displays are relatively disclosed in the art.

The column means 22, in this particular instance shown as vertically disposed, interconnects by means of bracing 23 to the supports 18 and 19, while the column extends further downwardly, as at 24, for interconnecting with bracing 25 at the lowermost frontal position of the frame means 2. A cross bracing 26 is provided, for further stability.

Figure 3:
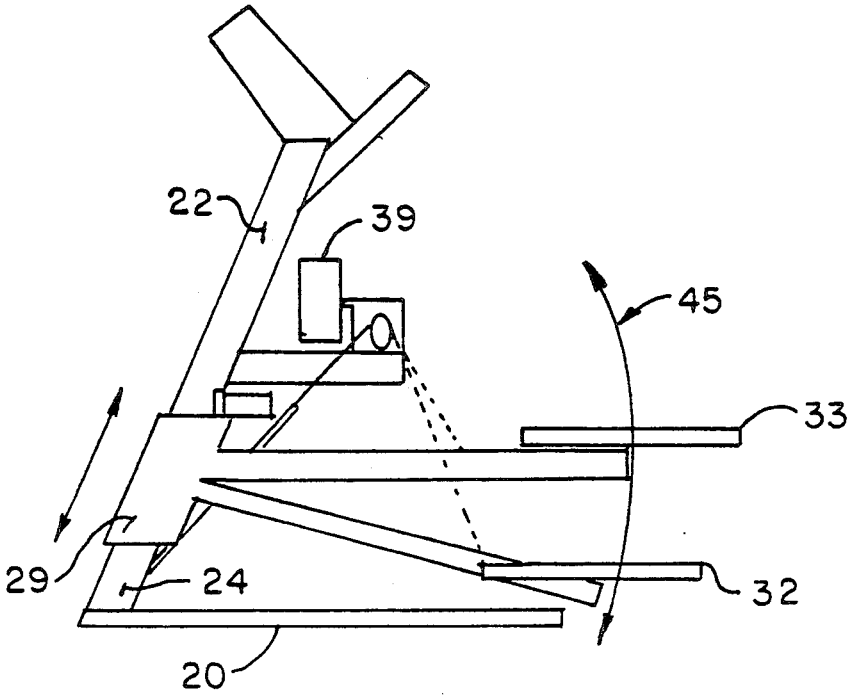
FIG. 3 provides a side schematic view of the simulator of this invention wherein its foot platforms are utilized for undertaking exercises similar to that of climbing a ladder.
Figure 4:
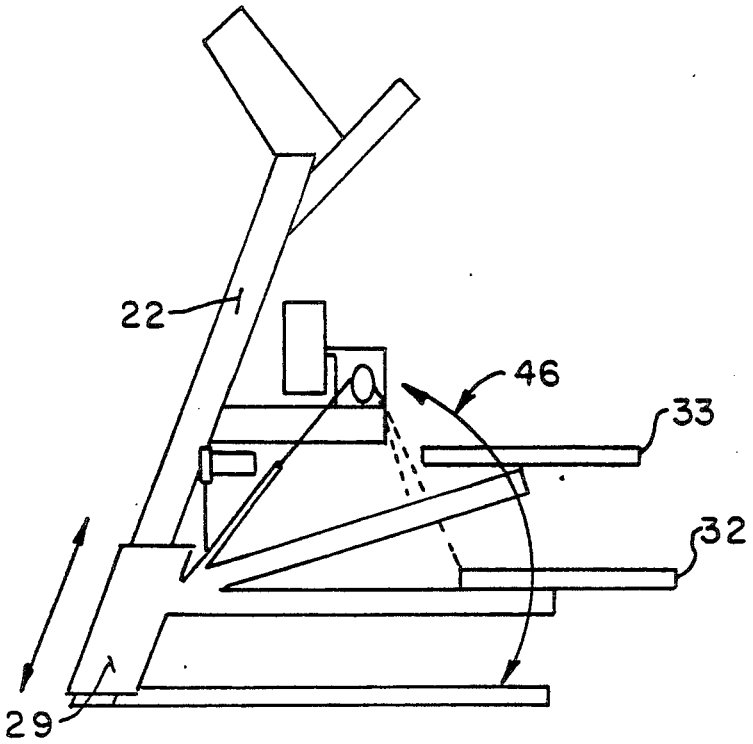
FIG. 4 provides a side schematic view of the simulator of this invention wherein its pivot assembly has been manipulated into position where the exerciser undertakes movement related to that of stair ascending.

While the column means 22 of this invention is disclosed as being arranged vertically aligned, in the preferred embodiment, it is preferred that the column have an inclined disposition, as can be seen at 22 within FIGS. 3 and 4.

Pivot axes 27 and 28 are pivotally mounted to the pivot assembly 29, and which pivot assembly is disposed for shifting movement, vertically, or approximately vertically, upon the column portion 24, as can be seen. The pivot assembly, in this instance, may undertake the configuration of a sleeve, as can also be seen in FIGS. 3 and 4. Connecting for pivotal movement upon the axes 27 and 28 are a pair of pivot arms, or links, 30 and 31, with one of each link connecting to each of the left and right foot platforms 32 and 33, respectively. As can be seen, each of the arms 30 and 31 are likewise pivotally connected by means of the pins 34 to the riser portion 35 of each of the platforms. The purpose for this is that the platforms 32 and 33 will remain horizontal with the surface, regardless of the disposition of the platform along the arc elevation of movement during their manipulation while exercising.

Means are provided for furnishing a resistance to the downward movement of the foot platforms during their manipulation. This is provided by means of a force biasing means, which in this particular instance comprises a pair of springs 36, which may connect to one of the axes 27 or 28, or even to the side of the pivot assembly 29. The opposite end of the springs 36 have a belt 37 connected thereto, and which are disposed over pulleys 38, as noted, and which will be subsequently defined. Thus, resistance is provided to the downward movement of the foot platforms 32 and 33, initially, by means of the force of the tension springs 36, because of their connection, at their belt ends, to the shown risers 35.

In addition, adjustable resistance may be provided to the movement of the foot platforms, by means of any form of mechanically adjustable resistance means. In the preferred embodiment, it includes a flywheel 39 that interconnects through a gear reducer 40, with a shaft 41 interconnecting through the gear reducer to the aforesaid pulleys 38. The belt 37 extends over the pulleys 38, and through adjusting of the flywheel 39, the degree of resistance required to pull the belt 37 over the pulleys 38 may be controlled, in order to vary the amount of force required to attain a downward shifting of the platforms 32 and 33, during undertaking of an exercising function. Obviously, other forms of force reducing means, of an equivalent structure, or which provide an equivalent result, and that is for varying the force required to attain movement of the foot platforms, may be embodied in this invention. See also FIG. 5.

As can be further seen in FIG. 2, the pivot assembly 29 has connecting to it a threaded screw 42 and which is operatively associated with a motor means 43, which may be of the reversing type, with the screw 42 threadedly engaging within a sleeve 44, and with said sleeve being connected to the pivot assembly 29. Hence, when the motor 43 is energized, in one direction or the other, the screw 42 is rotated, providing for its threaded engagement within the threaded sleeve 44, to raise or lower the pivot assembly 29, as can be understood. Obviously, once again, other equivalent mechanical or electrical means for raising or lowering of the pivot assembly 29, may be considered.

In referring to FIGS. 3 and 4, the principle of this invention, and what is desired to be attained through the usage, manipulation, and application of this invention, can be readily discerned. For example, it is to be noted in FIG. 3 that the pivot assembly is arranged at its uppermost position upon the lower column 24. When in this position, and due to the rearward incline in the disposition of the column 22, as can be noted, the arc angle of pivot for the foot platforms 32 and 33 is upon an arc that is nearly vertically disposed, as can be noted by the directional arrow 45. On the other hand, as can be seen in FIG. 4, when the pivot assembly 29 is lowered, through the energization of the motor means 43, in an opposite direction, the foot platforms, while having a similar arc angle pivot range, in this condition, provides a reorientation in its arc of movement, in a forwardly disposed direction as the foot platforms move upwardly, as can be noted by the directional angle 46. Thus, as disclosed in FIG. 3, the arc angle of movement of the foot platforms during their manipulation, while exercising, is generally in a vertical direction, and therefore, exercising upon the platforms when adjusted into such position is equivalent or similar to the exertion undertaken when climbing a ladder. On the other hand, and alternatively, when the pivot assembly is lowered with respect to the column 24, as can be seen in FIG. 4, the arc angle of pivot of the foot platforms is angulated forwardly of the structure, such that when one exercises upon the device when adjusted into this condition, the exercises undertaken simulate that of ascending stairs, and therefore, may exert stress and exercise upon different muscles, or from a different angle, upon the muscles, than from the adjusted position as shown in FIG. 3. These are examples of the dexterity in usage of this particular invention, as a result of the various adjustment features built into it.

Figure 5:
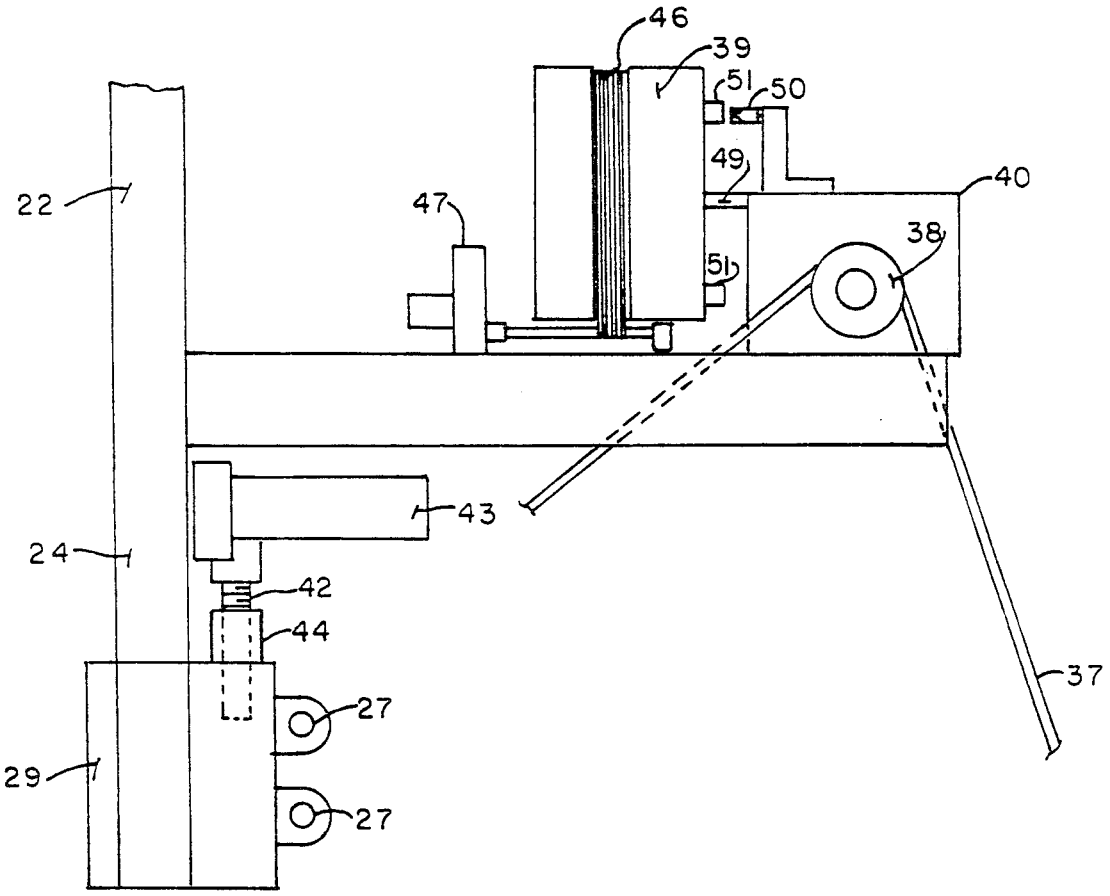
FIG. 5 provides a schematic view of the force resistance means, in this particular instance, comprising the flywheel and speed reducer, that provides means for adjusting the degree of resistance furnished by the foot platform during their manipulation.

As can be further seen in FIG. 5, the column 22, and more particularly its bottom segment 24, mounts for sliding movement of the pivot assembly 29 thereon. The pivot assembly 29 may have integrally formed rearwardly thereof, some pivot mounts, for mounting of the shafts 27 and 28, for supporting of the level arms 30 and 31, as previously explained. Thus, the actuation of the motor means 43, turns its threaded screw 42, within the sleeve 44, for raising or lowering of the pivot assembly 29, as previously explained.

In addition, the flywheel 39 may include, by way of example, a flywheel therein, and have a friction strap, as noted at 46, which may be adjusted by means of a servo motor 47, or the like, and which also may be actuated or adjusted by means of some push button control provided upon the control panel 48. Thus, the degree of resistance offered by the flywheel means 46, through its shaft 49, and into the gear reducer 40, may provide further adjustment to the degree of resistance offered by the foot platforms 32 and 33, when manipulated by the exerciser. A proximity sensor 50 that cooperates with magnets 51, may provide for an indication as to the speed of operations of the device, or the rate at which the foot platforms are depressed, so as to provide an indication, and readout, as to the climbing speed encountered by the exerciser, during usage of the device. These are just examples as to how the stair simulator of this invention, may incorporate operative components, to achieve its intended results.

Variations or modifications upon the subject matter of this invention may occur to those skilled in the art upon reviewing the subject matter of this invention. Such variations, if within the spirit of this invention, are intended to be encompassed within the scope of any claims to patent protection issuing upon this development. The description of the preferred embodiment set forth herein is done so for illustrative purposes only.

Having thus described the invention, what is claimed and desired to be secared by Letters Patent is:

1. A stair simulator exerciser for use in maintaining personal fitness comprising a frame means, a pivot assembly adjustably mounted to said frame means, a pair of foot platforms pivotally connected operatively to said pivot assembly, and said pivot assembly adjustably mounted for proximate vertical movement a select distance with respect to the frame means, so as to vary the orientation of the arc angle of movement of the foot platforms during their manipulation by the exerciser, and means for inducing resistance in the pivoting of the foot platforms during performance of an exercise function.

2. The invention of claim 1 and wherein said column being arranged angularly with respect to the vertical.

3. The invention of claim 2 and wherein said column angulating rearwardly with respect to the vertical.

4. The invention of claim 1 and including means operatively associated with said pivot assembly to vary the disposition of said assembly with respect to said column.

5. The invention of claim 4 and wherein each foot platform having a limited angle of pivot with respect to said pivot assembly.

6. The invention of claim 5 and wherein the pivot of each foot platform defining an arc path of movement, and the orientation of said arc path shifting as said pivot assembly is adjusted in its disposition upon the said column.

7. The invention of claim 6 and wherein said pair of foot platforms being pivotally moved during exercising, and requiring a stair climbing simulating motion to manipulate when said pivot assembly is disposed at its highest position upon the column, and requiring a ladder climbing simulating motion to manipulate when said pivot assembly is disposed at its lowest position upon said column.

8. The invention of claim 3 and wherein said means comprising a screw means threadedly engaging said pivot assembly, and motor means operatively associated with said screw means, and when energized, providing for a turning of said screw means and a shifting of said pivot assembly to another position upon the said column.

9. The invention of claim 1 and including force biasing means interconnecting between the frame means, and each pivot platform, to regulate the force required to achieve a pivot of said platforms during performance of exercising.

10. The invention of claim 9 and wherein said force biasing means includes a spring means to offer resistance against the pivot of the pair of the foot platforms.

11. The invention of claim 10 and including mechanical mean operatively associated with the force biasing means to vary the resistance offered by the platforms during pivoting while exercising.

12. The invention of claim 11 and wherein said mechanical means includes an adjustable fly wheel means for varying the resistance to pivoting of the foot platforms during exercising.

13. The invention of claim 12 and including a gear reducer operatively associated with the fly wheel to transmit the adjusted resistance to the foot platforms during exercising.

14. The invention of claim 9 and including control means operatively associated with the frame means, and connecting with the mechanical means for providing means for adjusting the resistance of the force biasing means.

15. The invention of cliam 14 and wherein said control means providing a visual display of the force required to pivot the foot platforms during exercising.

* * * * *